US009011313B2

(12) United States Patent
Matsubara et al.

(10) Patent No.: US 9,011,313 B2
(45) Date of Patent: Apr. 21, 2015

(54) MOVABLE WALL PORTION ATTACHMENT MECHANISM OF INCUBATOR

(75) Inventors: Kazuo Matsubara, Tokyo (JP); Terumi Matsubara, Saitama (JP); Tomoichi Kira, Saitama (JP); Toshio Otomo, Saitama (JP)

(73) Assignee: Atom Medical Corporation, Bunkyo-Ku, Tokyo (JP)

( * ) Notice: Subject to any disclaimer, the term of this patent is extended or adjusted under 35 U.S.C. 154(b) by 380 days.

(21) Appl. No.: 13/414,174

(22) Filed: Mar. 7, 2012

(65) Prior Publication Data

US 2012/0269568 A1 Oct. 25, 2012

(30) Foreign Application Priority Data

Apr. 19, 2011 (JP) ..... 2011-92786

(51) Int. Cl.
*A61G 11/00* (2006.01)

(52) U.S. Cl.
CPC ..... *A61G 11/006* (2013.01); *A61G 11/009* (2013.01); *A61G 11/008* (2013.01); *A61G 11/002* (2013.01); *A61G 2203/723* (2013.01)

(58) Field of Classification Search
USPC ..... 600/22
See application file for complete search history.

(56) References Cited

U.S. PATENT DOCUMENTS

| | | | | |
|---|---|---|---|---|
| 4,191,174 | A * | 3/1980 | Martin | 600/22 |
| 4,312,331 | A | 1/1982 | Hahmann | |
| 5,980,449 | A | 11/1999 | Benson et al. | |
| 6,397,836 | B1 * | 6/2002 | Pelletier et al. | 126/194 |
| 8,307,498 | B2 * | 11/2012 | Krammer | 16/83 |
| 8,409,073 | B2 * | 4/2013 | Ibara et al. | 600/22 |
| 2002/0017248 | A1 | 2/2002 | Honma et al. | |
| 2009/0286910 | A1 * | 11/2009 | Bloomfield | 524/269 |

FOREIGN PATENT DOCUMENTS

| | | |
|---|---|---|
| EP | 0811363 | 12/1997 |

* cited by examiner

*Primary Examiner* — Charles A Marmor, II
*Assistant Examiner* — Shannon McBride
(74) *Attorney, Agent, or Firm* — Hunton & Williams LLP

(57) ABSTRACT

According to the present invention, a movable wall portion for forming the outer circumference of an infant accommodation space can pivot forward about a portion of a region including the lower end portion and its vicinity of the movable wall portion from a substantially erect position to the outside of the infant accommodation space. The movable wall portion can move backward from a midway position in forward movement to the final backward moving position by its own weight while abrupt backward movement is suppressed by a damper. The present invention can provide a movable wall portion attachment mechanism of an incubator which does not produce a large sound or a large vibration when closing the movable wall portion, with a small chance that wall portions such as wall portions on the incubator base side, the movable wall portion or the like will be damaged.

12 Claims, 16 Drawing Sheets

MOVABLE WALL PORTION ATTACHMENT MECHANISM OF INCUBATOR

TECHNICAL FIELD

The present invention relates to a movable wall portion attachment mechanism of an incubator in which at least one wall portion of a plurality of wall portions attached to an incubator base so as to form an outer circumference of an infant accommodation space is attached as a movable wall portion to the incubator base, and the movable wall portion is configured to pivot forward about a portion of a region including a lower end portion and a vicinity thereof of the movable wall portion from a substantially erect position to the outside of an infant accommodation space.

BACKGROUND OF THE INVENTION

The movable wall portion attachment mechanism of an incubator, which has the above arrangement, has been conventionally known as disclosed in EP 0 811 363 A2 (to be referred to as "patent literature 1" hereinafter). The movable wall portion attachment mechanism (to be referred to as "the movable wall portion attachment mechanism in patent literature 1" hereinafter) of the incubator disclosed in patent literature 1 allows a doctor, a nurse or the like to provide various kinds of treatments for an infant, e.g., a newborn infant, lying on the bed base provided in the infant accommodation space of the incubator. That is, an operator such as a doctor, a nurse or the like makes at least one movable wall portion in a substantially erect position (in other words, in a closed state) pivot forward to the outside about a portion of a region including the lower end portion and its vicinity to set it in a substantially hanging position. This opens at least one side surface of the infant accommodation space, and hence allows a doctor, a nurse or the like to approach the infant from the open side surface and easily and quickly provide a necessary treatment for the infant. After providing a treatment, the doctor, the nurse or the like can close the infant accommodation space by making the movable wall portion in a substantially hanging position pivot backward in the direction opposite to that of the above forward pivoting movement.

With the movable wall portion attachment mechanism in patent literature 1, however, when the operator roughly shuts the movable wall portion, the movable wall portion impulsively comes into contact with the incubator base side or the like. This generates large sound and large vibration or damages part of the incubator base or part of a wall portion such as the movable wall portion or the like forming the infant accommodation space.

SUMMARY OF THE INVENTION

The present invention can reliably solve the above problem in the movable wall portion attachment mechanism disclosed in patent literature 1 with a relatively simple arrangement.

The present invention relates to a movable wall portion attachment mechanism of an incubator in which at least one wall portion of a plurality of wall portions attached to an incubator base so as to form an outer circumference of an infant accommodation space is attached as a movable wall portion to the incubator base, and the movable wall portion is configured to pivot forward about a portion of a region including a lower end portion and a vicinity thereof of the movable wall portion from a substantially erect position to an outside of the infant accommodation space, wherein when the movable wall portion moves backward from a midway position in backward movement to a final backward moving position, the movable wall portion moves backward to the final backward moving position by an own weight while abrupt backward movement of the movable wall portion is suppressed by damper means. With this arrangement, even if the operator roughly shuts the movable wall portion, there is no chance that the movable wall portion will impulsively come into contact with the incubator base side or other wall portion sides constituting the infant accommodation space. This prevents the generation of large sound or large vibration when the movable wall portion is closed, and hence does not psychologically affect an infant, e.g., a newborn infant, lying in the infant accommodation space. In addition, this arrangement prevents damage on a portion of the incubator base side or a portion of movable wall portion sides constituting the infant accommodation space. In spite of this, since the movable wall portion moves backward to the final backward moving position by its own weight, the operator can make the movable wall portion move backward to the final backward moving position with relatively easy operation.

According to the first aspect, the present invention is configured such that the mechanism comprises movable-side concave/convex engaging means provided on the movable wall portion side, and fixed-side concave/convex engaging means provided on the incubator base side, wherein the midway position in the backward movement is a position where the movable-side concave/convex engaging means is located substantially above the fixed-side concave/convex engaging means, and the final backward moving position is a position where the movable-side concave/convex engaging means moves backward from the midway position in the backward movement to a substantially lower position and engages with the fixed-side concave/convex engaging means. With this arrangement, it is possible to reliably hold the movable wall portion at the final backward moving position by engagement between the concave and convex portions. According to the first mode of the first aspect, the movable-side concave/convex engaging means comprises an engaging pin, and the fixed-side concave/convex engaging means comprises an engaging concave portion. With this arrangement, it is possible to reliably hold the above position with a simple arrangement.

According to the second aspect, the present invention is configured such that the movable wall portion is attached on the incubator base side through a support shaft portion so as to be configured to pivot forward and backward, and an axis of the support shaft portion is configured to move forward and backward in a substantially vertical direction relative to the incubator base. With this arrangement, it is possible to make the movable wall portion reliably pivot forward and backward and move vertically with a simple arrangement. According to the first mode of the second aspect, the mechanism further comprises a cam surface provided on the incubator base side, an impact attenuation portion provided on the cam surface and formed from an elastic body, and a cam surface abutment portion provided on the movable wall portion, wherein the cam surface abutment portion is configured to abut against the incubator base side first at the impact attenuation portion when the movable wall portion at a position where the support shaft portion of the movable wall portion is lowered is made to pivot backward from a forward pivot position. With this arrangement, it is possible to prevent the movable wall portion side from impulsively coming into contact with the incubator base with a simple arrangement when the movable wall portion pivots backward. In addition, the movable wall portion can be made to move backward to the final backward moving position by only making the movable wall portion simply pivot backward, without any necessity to lift the movable wall portion upward. According to the first mode of the second aspect, the cam surface abutment portion comprises an engaging pin, the mechanism further comprises an engaging concave portion provided on the incubator base side, and the engaging pin is configured to be engaged with the engaging concave portion at the final backward moving position. With this arrangement, it is possible to prevent the above impulsive contact and obviate the necessity to lift the movable wall portion, with a simple arrangement.

According to the third aspect, the present invention is configured such that the final backward moving position is a final backward pivot position where the movable wall portion is in a substantially vertical erect position, and the midway position in the backward movement is a position slightly before a position where the movable wall portion pivots backward to the final backward pivot position. With this arrangement, the movable wall portion attachment mechanism can be made to have a relatively simple arrangement, and the opening/closing operation of the movable wall portion can be relatively facilitated. In addition, according to the fourth aspect and the first mode of the third aspect, the movable wall portion is attached to the incubator base side through a support shaft portion so as to pivot forward and backward, and an axis of the support shaft portion is at a substantially constant position relative to the incubator base. This arrangement can further simplify the arrangement of the attachment mechanism.

According to the fifth aspect, the present invention is configured such that the damper means comprises a cylinder piston type linear damper. With this arrangement, it is possible to reliably prevent the movable wall portion from impulsively coming into contact with the incubator base side or other wall portion sides constituting the infant accommodation space with a relatively simple arrangement. According to the first mode of the fifth aspect, an impact attenuation member formed from an elastic body is provided on at least a distal end portion of a piston portion of the linear damper, and an abutment portion of the movable wall portion side abuts against the impact attenuation member when the movable wall portion moves backward from the midway position in the backward movement to the final backward moving position. With this arrangement, it is possible to further reliably prevent the above impulsive contact with a simple arrangement.

According to the sixth aspect, the present invention is configured such that when the movable wall portion pivots forward, abrupt forward pivoting movement of the movable wall portion is suppressed by the second damper means. This arrangement eliminates the chance that when the movable wall portion pivots forward to the final forward pivot position, the movable wall portion will not damage the incubator base side or the like by impulsively coming into contact with the incubator base side or the like. According to the first mode of the sixth aspect, when the movable wall portion pivots backward, abrupt backward pivoting movement of the movable wall portion is not substantially suppressed by the second damper means. With this arrangement in the movable wall portion attachment mechanism having the effect of the sixth aspect, when the movable wall portion pivots backward, since the backward pivoting movement of the movable wall portion is not substantially suppressed by the second damper means, it is possible to make the movable wall portion pivot relatively smoothly. According to the second mode of the sixth aspect, the second damper means comprises a rotary damper. With this arrangement, as described above, it is possible to reliably prevent the movable wall portion from impulsively coming into contact with the incubator base side or the like when pivoting forward (in some case, in addition to this, it is possible to make the movable wall portion pivot forward relatively smoothly), with a simple arrangement. According to the third mode of the sixth aspect, when the movable wall portion pivots backward, abrupt forward pivoting movement of the movable wall portion is not substantially suppressed by any of the damper means. With this arrangement in the movable wall portion attachment mechanism having the effect of the sixth aspect, when the movable wall portion pivots backward, since the backward pivoting movement of the movable wall portion is not substantially suppressed by any of the damper means, it is possible to make the movable wall portion pivot relatively smoothly.

The above, and other, objects, features and advantages of the present invention will become readily apparent from the following detailed description thereof which is to be read in connection with the accompanying drawings.

DETAILED DESCRIPTION OF THE INVENTION

The first embodiment in which the present invention is applied to an open type incubator (a so-called infant warmer) and the second embodiment in which the present invention is applied to a closed type incubator will be described in "1. First Embodiment" and "2. Second Embodiment", respectively, with reference to the accompanying drawings.

1. First Embodiment

The first embodiment of the present invention will be described separately in the following items: "(1) Overall Schematic Arrangement of Incubator", "(2) Arrangement of Movable Wall Portion Attachment Mechanism" and "(3) Operation of Movable Wall Portion Attachment Mechanism" with reference to FIGS. 1 to 11.

(1) Overall Schematic Arrangement of Incubator

Figure 1:
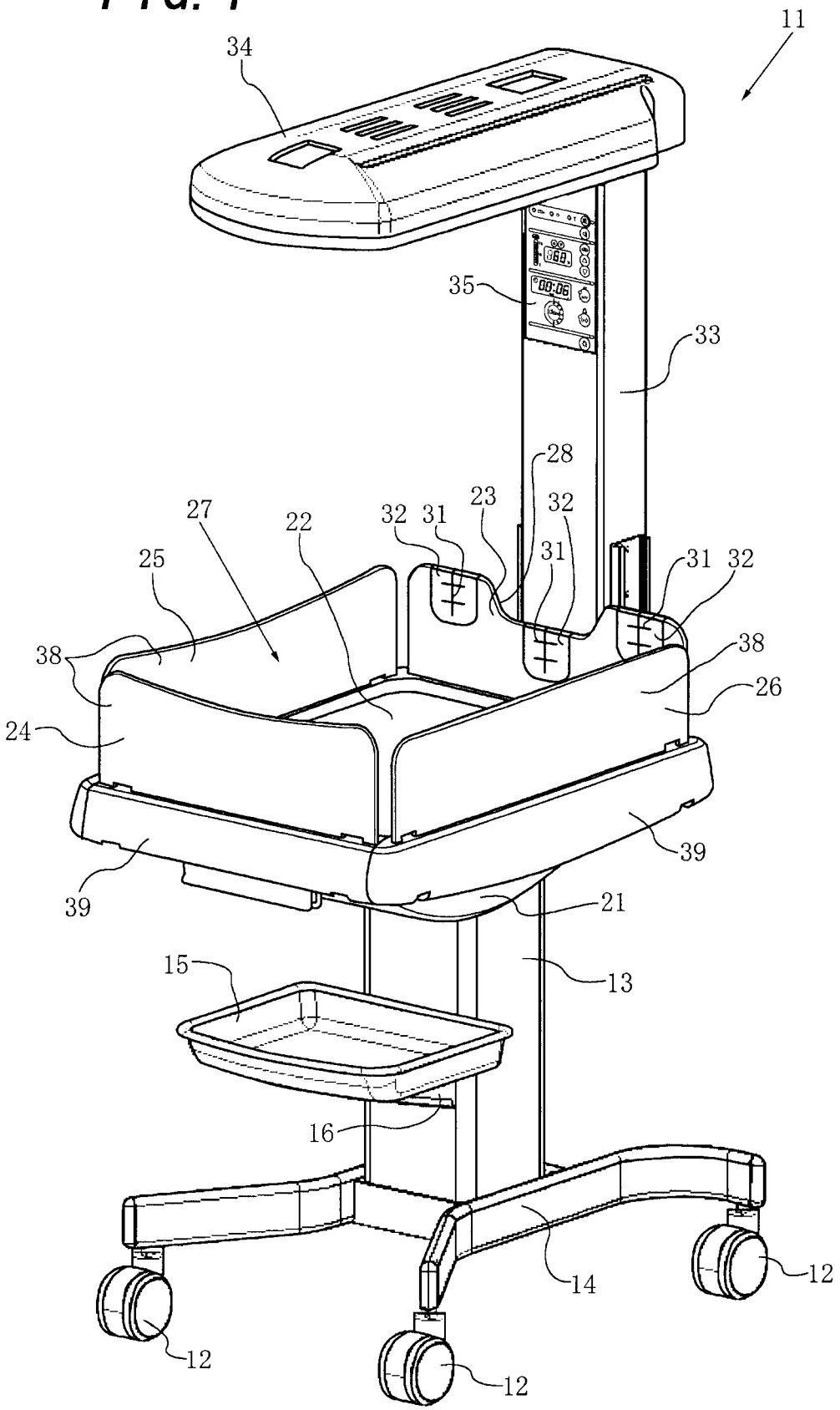
FIG. 1 is a perspective view showing an open type incubator in a normal use state according to the first embodiment of the present invention.

As shown in FIG. 1, an open type incubator 11 includes a carriage 14 on which wheels 12 and a main strut 13 are mounted. More specifically, the wheels 12 are mounted below the four corners of the carriage 14. The main strut 13 is mounted on the carriage 14. A tray support portion 16 which can support a tray 15 is provided on the main strut 13.

Figure 2:
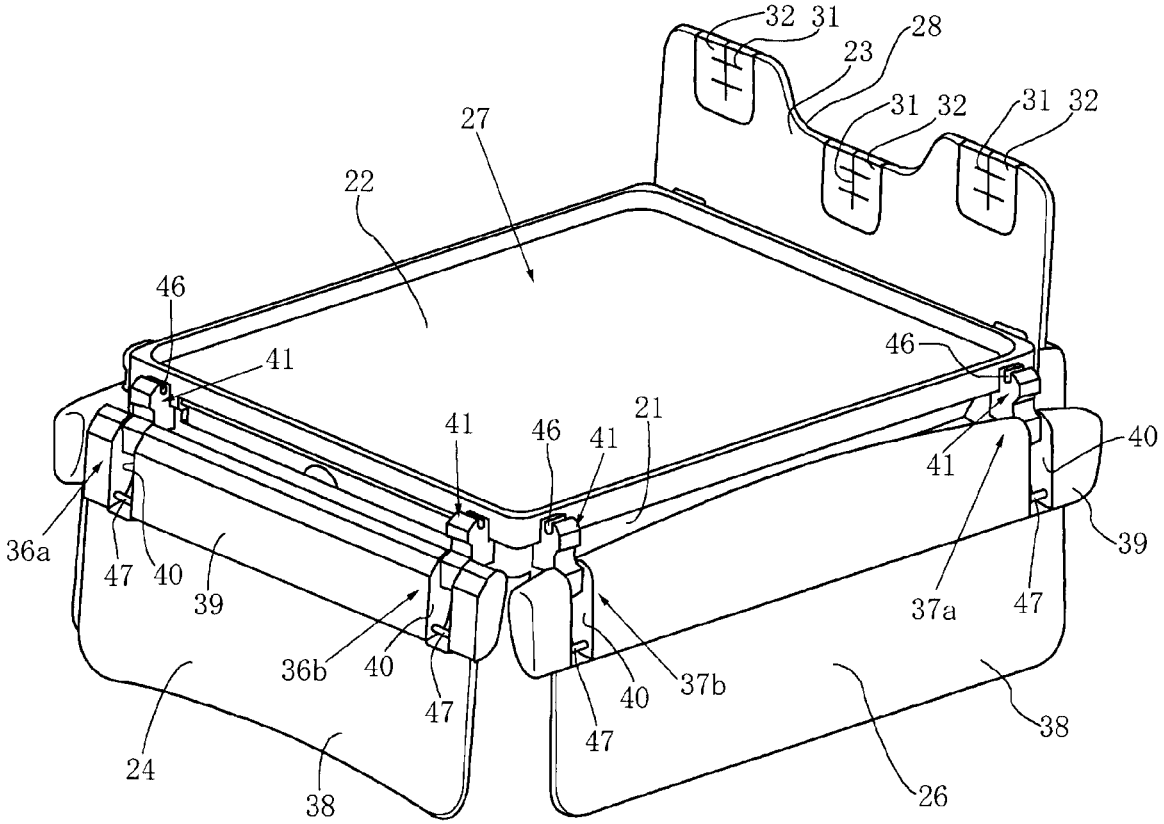
FIG. 2 is a perspective view of a portion around the bed base while the movable wall portions of the incubator in three directions shown in FIG. 1 are open.

As shown in FIGS. 1 and 2, an incubator base 21 is provided on the main strut 13. A flat container-shaped bed base (in other words, a mattress tray) 22 is provided on the base 21. A mattress (not shown) on which an infant, e.g., a newborn infant, can be laid down can be placed on the bed base 22. The incubator base 21 is provided with a fixed wall portion 23 which is adjacent to a strut 33 extending upright from the base 21 and forms a wall portion on the head side of the infant, a leg-side movable wall portion 24 which forms a wall portion on the leg side of the infant, a left movable wall portion 25 which forms a wall portion on the left side of the infant, and a right movable wall portion 26 which forms a wall portion on the right side of the infant. These four wall portions are arranged in a substantially rectangular shape as a whole when viewed from above. In addition, the bed base 22, and the fixed wall portion 23 and movable wall portions 24 to 26, each of which can take a substantially rectangular shape, constitute an infant accommodation space 27 having a substantially rectangular parallelepiped shape with an open upper surface. Therefore, the left movable wall portion 25 and the right movable wall portion 26 can have substantially the same dimensions. The fixed wall portion 23 and the leg-side movable wall portion 24, each of which is slightly shorter than the movable wall portions 25 and 26, can have the same dimensions except for a notched portion 28 provided in the upper side portion of the fixed wall portion 23. Note that the fixed wall portion 23 can be entirely formed from a substantially transparent plastic plate. The movable wall portions 24 to 26 each can pivot forward and backward, about a portion of a region including a lower side portion and its vicinity in the substantially upward erect position shown in FIG. 1, between the substantially upward erect position shown in FIG. 1 and the substantially downward hanging position shown in FIG. 2. These arrangements will be described in detail in the next item "(2) Arrangement of Movable Wall Portion Attachment Mechanism".

As shown in FIG. 1, a proper number of grommet members 32 each having cuts for holding a cable can be attached to the fixed wall portion 23. A longitudinal member (not shown) such as an oxygen supply tube can be held in cuts 31 while extending through the grommet member 32. An infrared heater 34 is provided on the upper end portion of the strut 33. Various kinds of measuring instruments 35 for body temperature, $SpO_2$ and the like are provided on the strut 33 so as to be located between the infrared heater 34 and the infant accommodation space 27. More specifically, the measuring instruments 35 can display a body temperature by receiving a signal from a body temperature probe which measures the body temperature of an infant, and control, for example, the heating temperature of the infrared heater 34.

(2) Arrangement of Movable Wall Portion Attachment Mechanism

As shown in FIG. 2, the leg-side movable wall portion 24 is attached to the base 21 with a pair of left and right movable wall portion attachment mechanisms 36*a* and 36*b* having substantially the same structure except that they are symmetrically formed in the lateral direction. In addition, the left and right movable wall portions 25 and 26 each are attached to the base 21 with a pair of front and rear movable wall portion attachment mechanisms 37*a* and 37*b* having substantially the same structure except that they are symmetrically formed in the back and forth direction. The movable wall portion attachment mechanisms 37*a* and 37*b* can have substantially the same arrangement on each of the left and right movable wall portions 25 and 26 except that they are symmetrically formed in the back and forth direction. Therefore, one attachment mechanism 36*b* for the leg-side movable wall portion 24 will be described in detail below with reference to FIGS. 3 to 11, and a detailed description of the remaining attachment mechanisms 36*a*, 37*a*, and 37*b* will be properly omitted.

Figure 3:
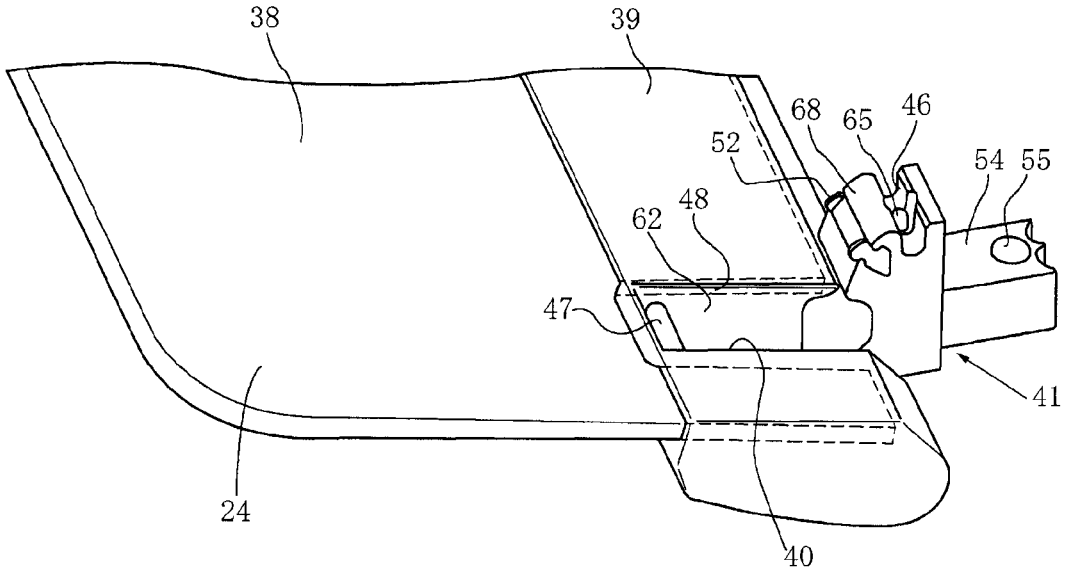
FIG. 3 is a perspective view of part of the leg-side movable wall portion shown in FIG. 2 while it is open at 90°.

As shown in FIG. 3, the movable wall portion 24 includes an upper-side portion (in other words, a transparent plate portion) 38 formed from a substantially transparent plastic plate and a lower-side portion (in other words, a movable wall proximal portion) 39 to which the lower end portion of the upper-side portion 38 is attached. The movable wall proximal portion 39 is provided with a cutout portion (in other words, a concave portion having an open lower end) 40 for accommodating a coupling member 41 described in item (a) described later. The lower end portion of the transparent plate portion 38 is therefore provided with a cutout portion 48 corresponding to the cutout portion 40.

As shown FIGS. 2 to 11, the movable wall portion attachment mechanism 36*b* includes the components described in items (a) to (h) as follows:

(a) the coupling member 41 fixed to the incubator base 21;

(b) a coupling pin 42 as a support shaft portion which forms the pivot center of the movable wall portion 24 whose movable wall proximal portion 39 is pivotally supported on the coupling member 41;

(c) a guide hole 43 which is provided in the coupling member 41 so as to extend through it in a substantially horizontal direction;

(d) a bearing member 44 which is provided in the guide hole 43 to axially support the coupling pin 42;

(e) a rotary damper 45 which couples the movable wall proximal portion 39 (in other words, the movable wall portion 24) to the bearing member 44;

(f) an engaging pin 47 as a concave/convex engaging means on the movable side which is provided on the movable wall proximal portion 39 (in other words, the movable wall portion 24) to engage with an engaging concave portion 46 as a concave/convex engaging means on the fixed side which is provided in the coupling member 41 so as to extend in a substantially horizontal direction;

(g) a cylinder piston type linear damper 51 which is accommodated in an accommodation hole 53 provided in the coupling member 41 so as to extend in a substantially vertical direction, and against which the engaging pin 47 abuts when it engages with the engaging concave portion 46; and (h) an impact attenuation member 52 as an impact attenuation portion which is provided in the coupling member 41 so as to abut against the engaging pin 47 when the movable wall portion 24 (in other words, the movable wall proximal portion 39) in a substantially hanging position (in other words, an open state) shifts to a substantially erect position (in other words, a closed state).

As shown in FIG. 3, an attachment portion 54 extends from the coupling member 41 toward the base 21. An attachment hole 55 is provided in the attachment portion 54. The coupling member 41 is attached and fixed to the incubator base 21 with a bolt extending through the attachment hole 55 and a nut or with a screw (neither of which is shown).

Figure 4:
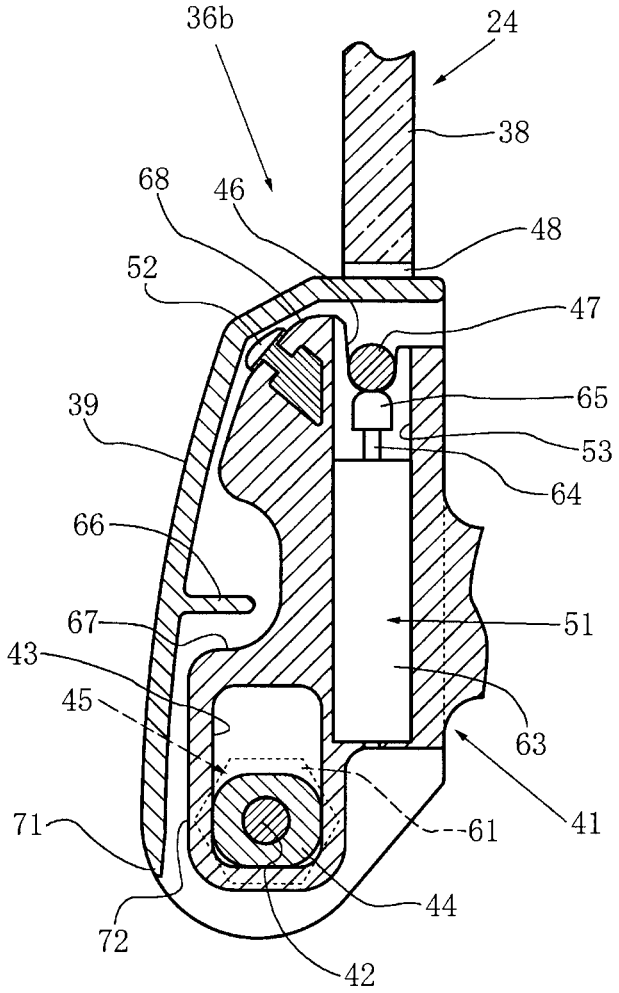
FIG. 4 is a longitudinal sectional view of a portion around the hinge portion of the leg-side movable wall portion shown in FIG. 1.

As shown in FIGS. 3 and 4, the coupling pin 42 is attached to both left and right wall portions 62 of the cutout portion 40 of the movable wall proximal portion 39. The guide hole 43 is formed to have a substantially rectangular longitudinal section which is substantially vertically long. The bearing member 44 is formed to have a substantially rectangular longitudinal section which is substantially vertically or horizontally long or a square longitudinal section so as to substantially vertically slidable in the guide hole 43. In addition, the corner portions of the longitudinal sections of the guide hole 43 and bearing member 44 are rounded in the embodiment shown in the accompanying drawings.

As shown in FIG. 4, the rotary damper 45 includes a damper main body 61 attached and fixed to the movable wall proximal portion 39 and a pivot shaft (not shown) attached to the damper main body 61 so as to be relatively pivotal forward and backward. The above pivot shaft is provided substantially coaxially with the coupling pin 42 and is integrally coupled to the bearing member 44 in the rotating direction. When the damper main body 61 pivots about its pivot center (in other words, the above pivot shaft) in the counterclockwise direction in FIG. 4, the rotary damper 45 applies a large pivoting load (in other words, a force to delay pivoting movement) to the damper main body 61. When the damper main body 61 pivots about its pivot center (in other words, the above pivot shaft) in the clockwise direction in FIG. 4, the pivoting load applied from the rotary damper 45 greatly decreases to substantially 0.

As shown in FIGS. 3 and 4, the engaging pin 47 is attached to the left and right wall portions 62 of the cutout portion 40 of the movable wall proximal portion 39. A cylinder portion 63 of the linear damper 51 is accommodated in the accommodation hole 53 while being attached and fixed. A piston portion 64 of the linear damper 51 protrudes substantially upward from the cylinder portion 63. When the piston portion 64 of the linear damper 51 reciprocates substantially downward, the linear damper 51 applies a large moving load (in other words, a force to delay movement) to the piston portion 64.

Figure 5:
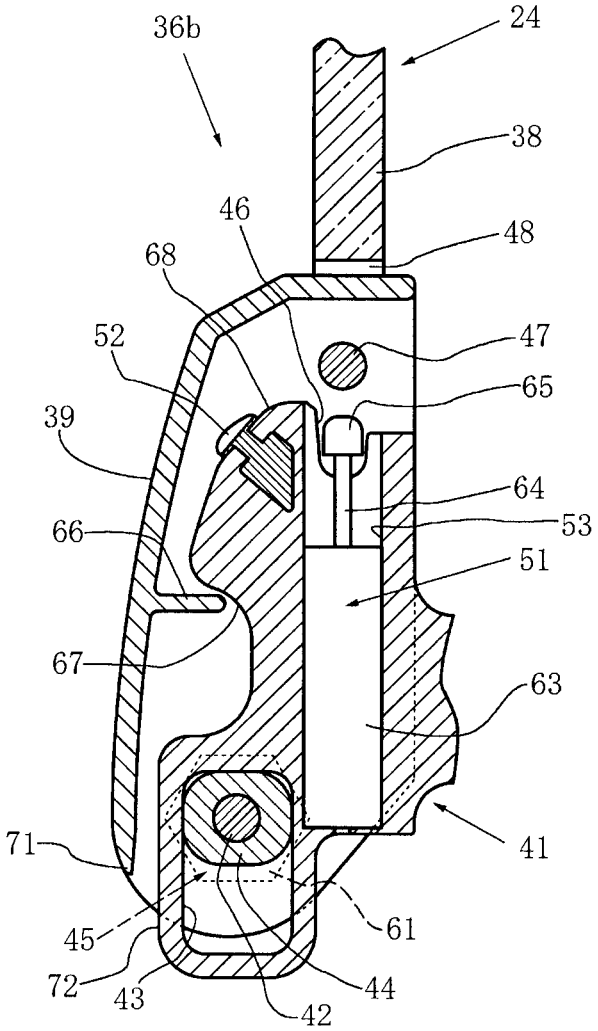
FIG. 5 is a longitudinal sectional view of a region around the hinge portion shown in FIG. 4 while the leg-side movable wall portion is raised.

As shown in FIGS. 4 and 5, an impact attenuation member 65 as an impact attenuation portion formed from an elastic body such as a rubber material is attached to the distal end portion of the piston portion 64. The impact attenuation member 52 as an impact attenuation portion formed from an elastic body such as a rubber material is provided on a shoulder portion 68 of the outside surface of the coupling member 41. Note that the shoulder portion 68 can also function as a guide surface for the engaging pin 47. A reinforcing rib 66 extending in a substantially horizontal direction in the closed state of the movable wall portion 24 is integrally formed with the inside surface of the movable wall proximal portion 39. A concave portion 67 as a clearance for the reinforcing rib 66 is provided in the outside surface of the coupling member 41.

(3) Operation of Movable Wall Portion Attachment Mechanism

In the closed state of the leg-side movable wall portion 24 shown in FIGS. 1 and 4, the coupling member 41 is covered from outside by the movable wall proximal portion 39. In addition, in the closed state, the bearing member 44 is lowered to a region including the lower end and its vicinity of the guide hole 43, and hence the coupling pin 42 is also located below the guide hole 43. In addition, the rotary damper 45 whose pivot shaft is provided substantially coaxially with the coupling pin 42 is lowered. In this closed state, the engaging pin 47 functioning as a stopper for the movable wall portion 24 is substantially completely engaged with the engaging concave portion 46. Therefore, the engaging pin 47 abuts against the impact attenuation member 65 of the linear damper 51 and is pressing the piston portion 64 down.

Figure 8:
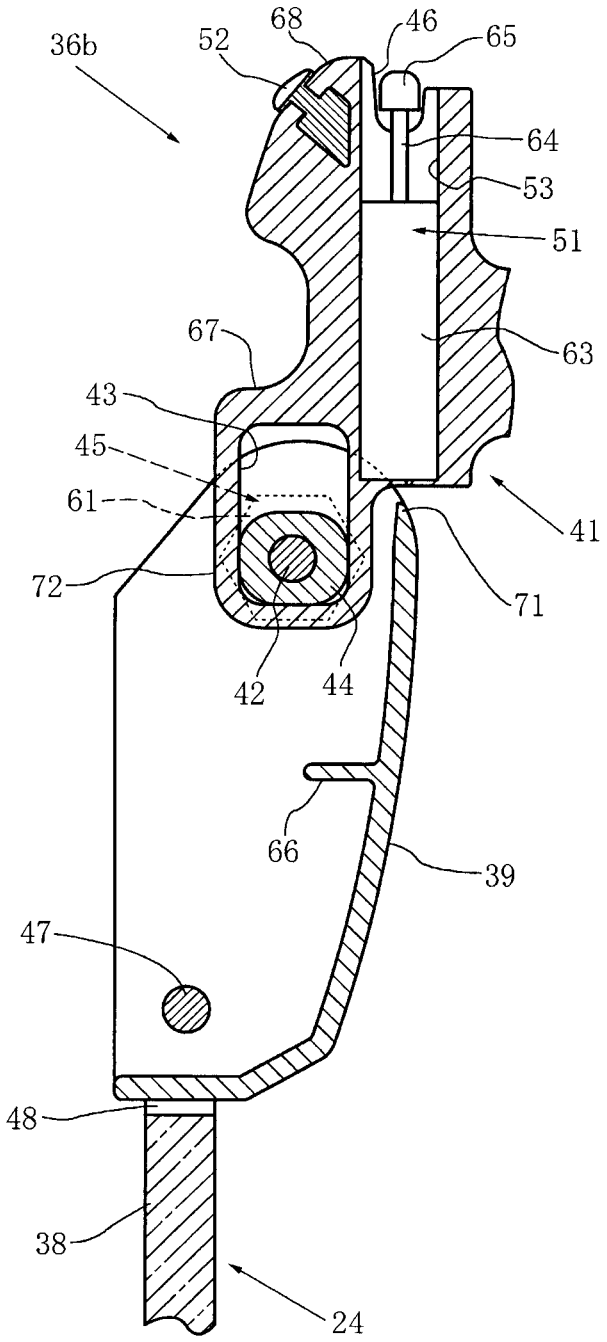
FIG. 8 is a longitudinal sectional view of the portion around the hinge portion shown in FIG. 6 while the leg-side movable wall portion is made to pivot forward to a substantially vertically hanging position.

In order to shift the closed state of the leg-side movable wall portion 24 shown in FIGS. 1 and 4 to the open state shown in FIG. 8, first of all, the operator holds the leg-side movable wall portion 24 with his/her hand and lifts it upward, as shown in FIG. 5. As the operator lifts the movable wall portion 24, the engaging pin 47 moves substantially upward from the engaging concave portion 46 of the coupling member 41, as shown in FIG. 5. This makes the piston portion 64 of the linear damper 51 moves backward in a substantially upward direction. The bearing member 44 then moves forward from down to up in the guide hole 43 and abuts against the upper surface of the guide hole 43, thereby stopping the forward movement. Therefore, the upper surface of the guide hole 43 functions as a stopper for the bearing member 44 (eventually, the leg-side movable wall portion 24). In addition, like the bearing member 44, the rotary damper 45 moves forward in a substantially upward direction, accompanied by the movable wall proximal portion 39 of the leg-side movable wall portion 24.

Figure 6:
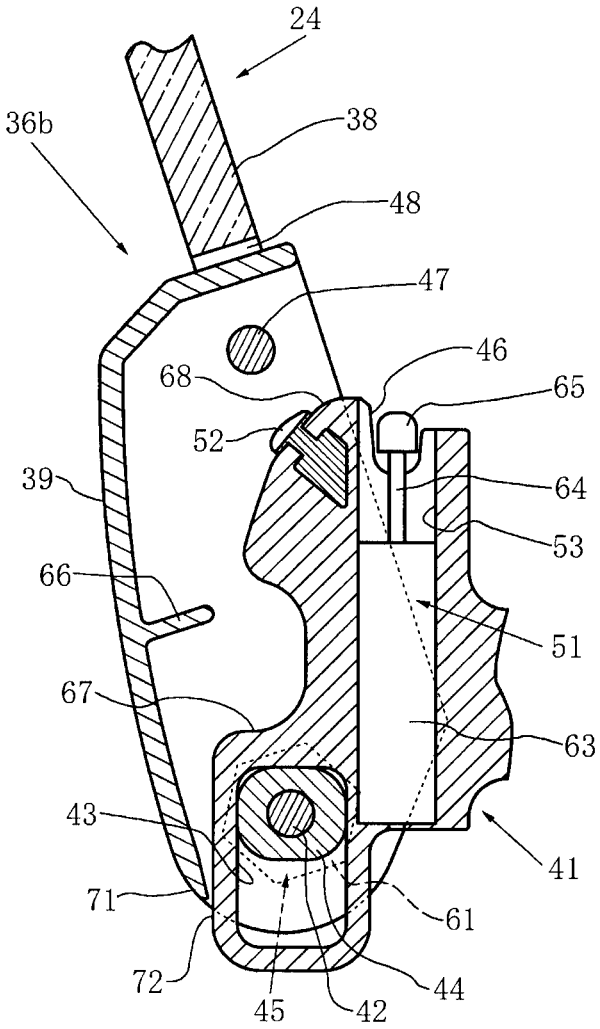
FIG. 6 is a longitudinal sectional view of the portion around the hinge portion shown in FIG. 5 while the leg-side movable wall portion is made to slightly pivot forward.
Figure 7:
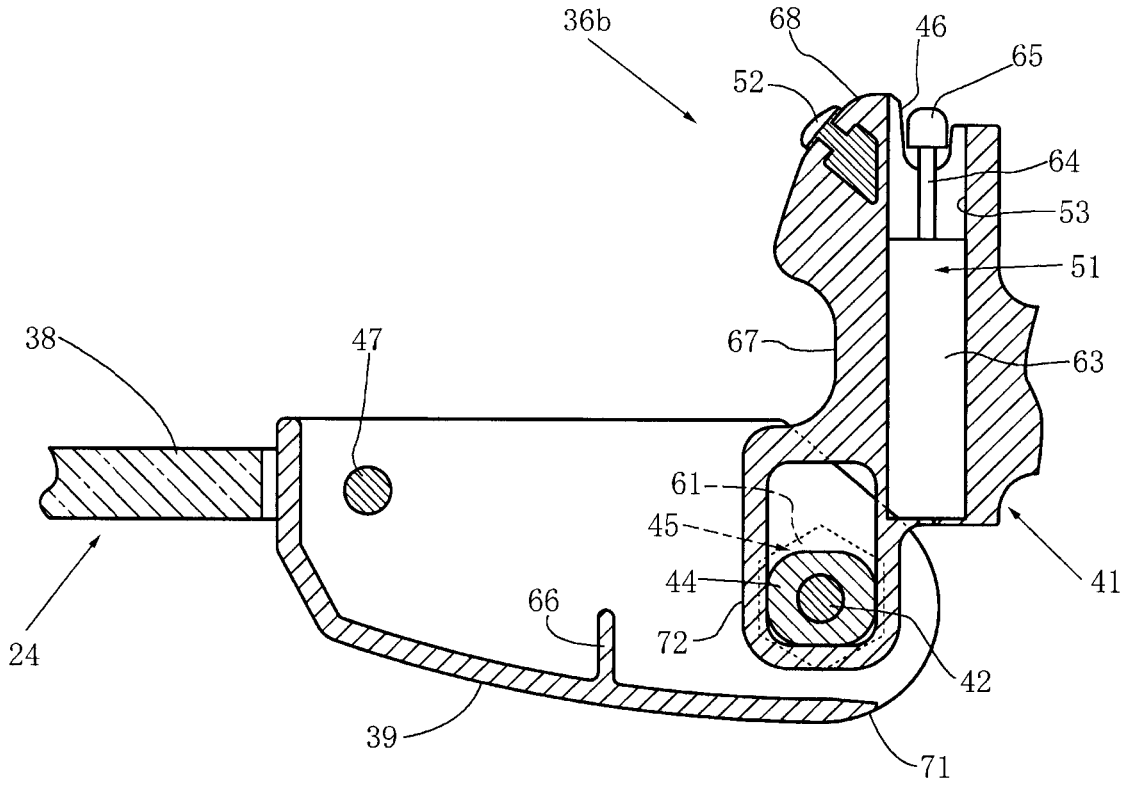
FIG. 7 is a longitudinal sectional view of the portion around the hinge portion shown in FIG. 6 while the leg-side movable wall portion is made to pivot forward to a substantially horizontal position.

When the operator makes the leg-side movable wall portion 24 in the lifted state shown in FIG. 5 pivot forward to the outside about the coupling pin 42 to set the movable wall portion 24 in an open state while holding it with his/her hand, the movable wall portion 24 gradually pivots forward to shift to the open state, as sequentially shown in FIGS. 6, 7 (in other words, FIG. 3), and 8. In this case, when the operator makes the leg-side movable wall portion 24 in the lifted state shown in FIG. 5 pivot forward to the position shown in FIG. 6, a stopped portion 71 of the movable wall proximal portion 39 abuts against a stopper portion 72 of the coupling member 41. For this reason, the movable wall portion 24 can only pivot forward to the state shown in FIG. 6. In order to make the movable wall portion 24 further pivot from the state shown in FIG. 6, the operator moves the movable wall portion 24 substantially downward under its own weight or by pressing it down with his/her hand. With this downward movement, the bearing member 44 moves below the guide hole 43, and hence the stopped portion 71 also moves below the stopper portion 72 (in other words, the coupling member 41). This cancels the abutment between the stopper portion 72 and the stopped portion 71. Making the leg-side movable wall portion 24 further pivot forward under its own weight or by manual operation will shift the leg-side movable wall portion 24 to the open state shown in FIGS. 2 and 8 through the substantially horizontal state shown in FIGS. 3 and 7. When the leg-side movable wall portion 24 in the closed state shown in FIG. 4 shifts to the open state shown in FIG. 8, the rotary damper 45 applies a large pivoting load to the movable wall proximal portion 39 (eventually, the leg-side movable wall portion 24). This prevents the leg-side movable wall portion 24 in the intermediate state shown in FIG. 7 from abruptly shifting to the open state shown in FIG. 8 upon abrupt forward pivoting movement in the opening direction due to its own weight or the like. It is therefore possible to effectively prevent the leg-side movable wall portion 24 from making an impact on the incubator base 21 or the like upon abrupt forward pivoting movement of the leg-side movable wall portion 24.

In order to shift the open state of the leg-side movable wall portion 24 shown in FIGS. 2 and 8 to the closed state shown in FIGS. 1 and 4, the operator lifts the leg-side movable wall portion 24 substantially obliquely upward with his/her hand. Lifting the leg-side movable wall portion 24 in this manner will make the leg-side movable wall portion 24 pivot backward about the coupling pin 42 from the state shown in FIG. 8 to the state shown in FIG. 9. In this case, since the rotary damper 45 does not substantially apply a pivoting load on the leg-side movable wall portion 24, the operator can lift the leg-side movable wall portion 24 relatively smoothly.

Figure 9:
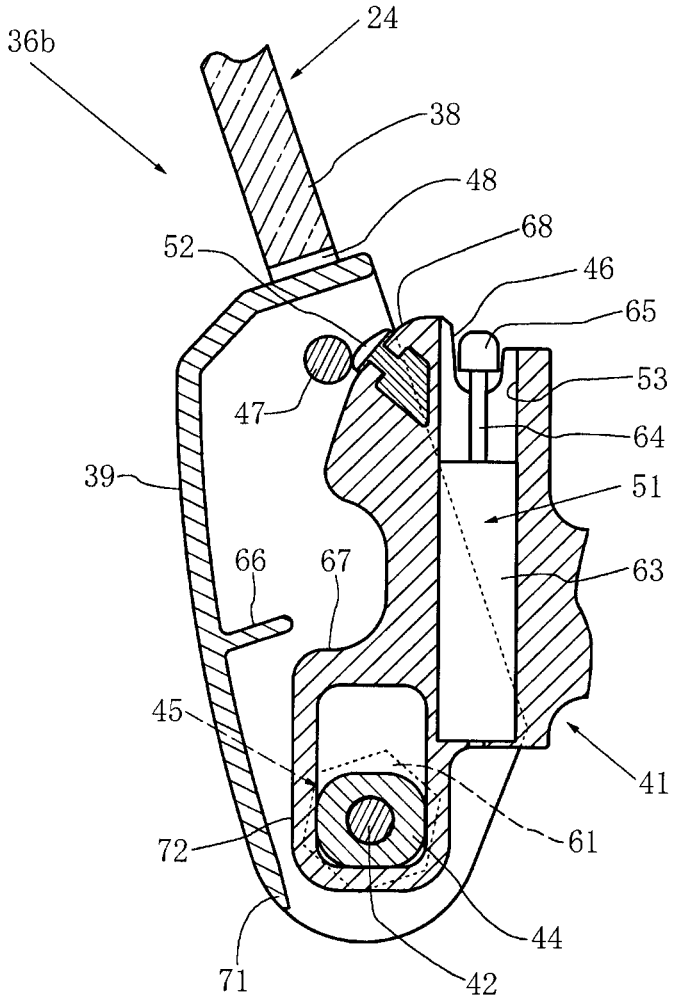
FIG. 9 is a longitudinal sectional view of the portion around the hinge portion shown in FIG. 8 while the leg-side movable wall portion is closed to the state shown in FIG. 6.
Figure 10:
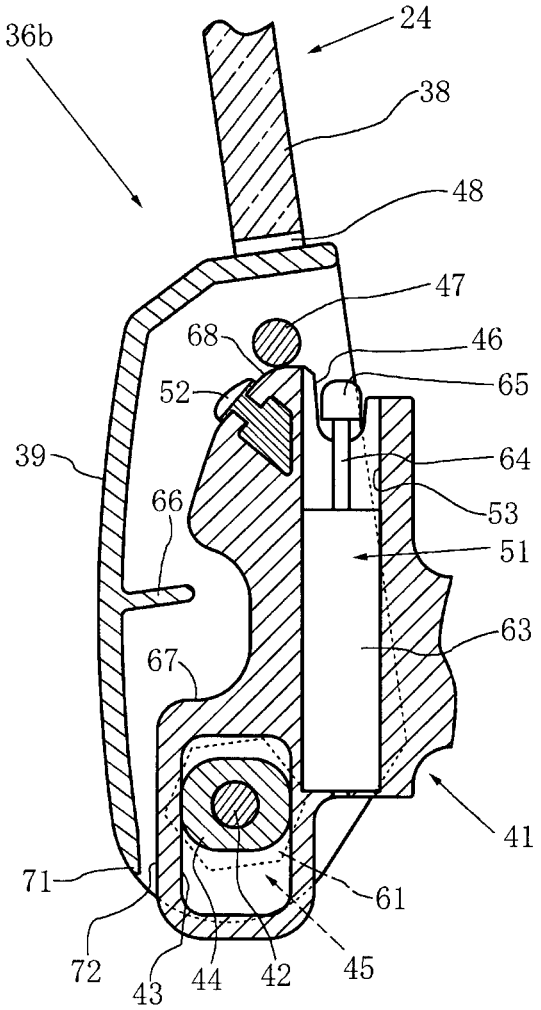
FIG. 10 is a longitudinal sectional view of the portion around the hinge portion shown in FIG. 9 while the leg-side movable wall portion is further closed.

In the state shown in FIG. 9 in which the leg-side movable wall portion 24 is on the way during the above backward pivoting movement, the engaging pin 47 of the leg-side movable wall portion 24 abuts against the impact attenuation member 52 on the coupling member 41 side. For this reason, if the operator makes the leg-side movable wall portion 24 further pivot backward while slightly lifting it with his/her hand, the engaging pin 47 sequentially rides over the impact attenuation member 52 and the shoulder portion 68, as shown in FIG. 10. Therefore, the leg-side movable wall portion 24 is slightly lifted upward, the coupling pin 42, the bearing member 44 and rotary damper 45 move upward relative to the guide hole 43. In this case, the impact attenuation member 52 and the shoulder portion 68 form a cam surface on the incubator base 21 side. The engaging pin 47 of the leg-side movable wall portion 24 forms a cam surface abutment portion which abuts against the cam surface (in other words, the impact attenuation member) first when the leg-side movable wall portion 24 pivots backward while the coupling pin 42 is at the lower position.

Figure 11:
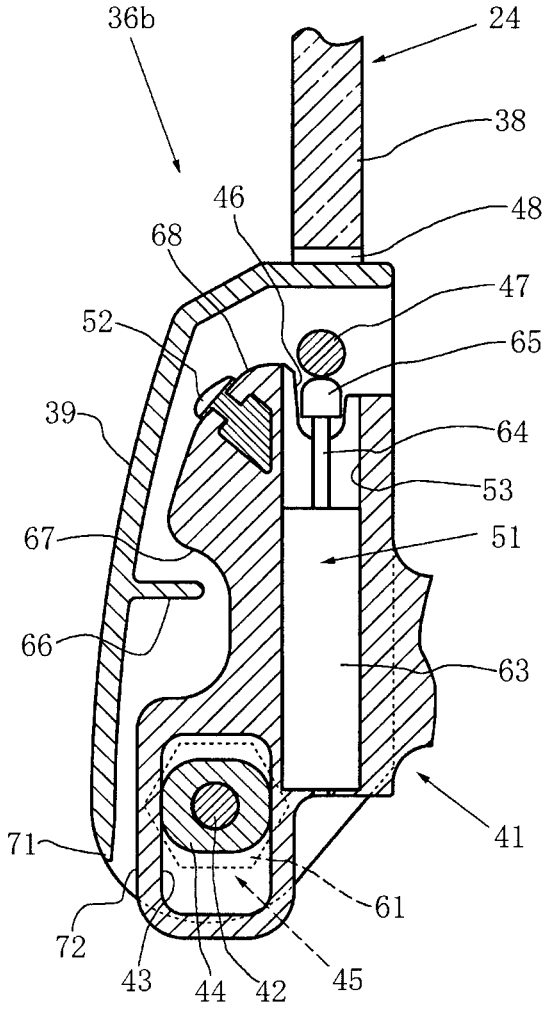
FIG. 11 is a longitudinal sectional view of the portion around the hinge portion shown in FIG. 10 while the leg-side movable wall portion is further closed to the state shown in FIG. 4.

When the operator makes the leg-side movable wall portion 24 shown in FIG. 10 further pivot about the coupling pin 42, the leg-side movable wall portion 24 is set in a substantially erect position (in other words, in a closed state), as shown in FIG. 11. In the state shown in FIG. 11, the engaging pin 47 presses the impact attenuation member 65 substantially downward under the weight of the leg-side movable wall portion 24 or under the like. In this case, since the impact attenuation member 65 is formed from an elastic body, the pressing force applied from the engaging pin 47 to the impact attenuation member 65 is made relatively soft. The engaging pin 47 is slowly engaged with the engaging concave portion 46 owing to the weight of the leg-side movable wall portion 24 or the like, and the moving load applied by the linear damper 51. Finally, the engaged state shown in FIG. 4 can be obtained. Therefore, there is no chance that the leg-side movable wall portion 24 side will abruptly move backward to the final backward moving position. This eliminates the chance that abrupt backward movement or the like will produce large sound or damage part of the incubator base 21 side or part of the leg-side movable wall portion 24.

2. Second Embodiment

The second embodiment of the present invention will be described next separately in the following items with reference to FIGS. 12 to 17: "(1) Overall Schematic Arrangement of Incubator", "(2) Arrangement of Movable Wall Portion Attachment Mechanism" and "(3) Operation of Movable Wall Portion Attachment Mechanism". Note that in the first embodiment described above, the present invention is applied to an open type incubator, whereas in the second embodiment, the present invention is applied to a closed type incubator. The differences in arrangement and operation between the incubator of the second embodiment and the incubator of the first embodiment described above will be basically described below. The items described above in the first embodiment apply to the second embodiment unless any contradictions occur. In the second embodiment, parts corresponding to those in the first embodiment described above will be denoted by the same reference numerals as in the first embodiment.

(1) Overall Schematic Arrangement of Incubator

Figure 12:
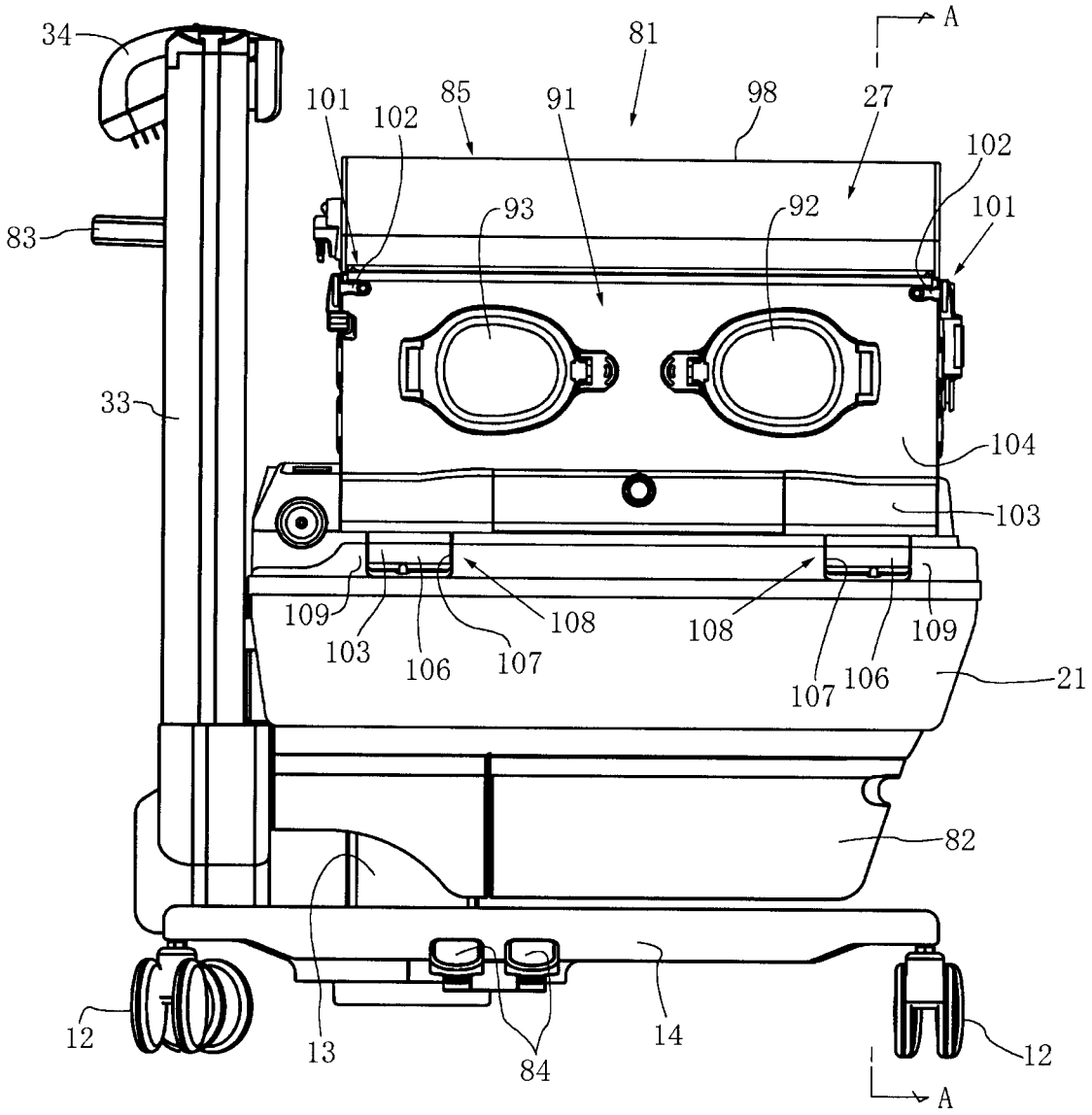
FIG. 12 is a front view showing a closed type incubator in a normal use state according to the second embodiment of the present invention.

As shown in FIG. 12, like the open type incubator 11 according to the first embodiment, a closed type incubator 81 includes wheels 12, a main strut 13, a carriage 14, an incubator base 21, a strut 23, and an infrared heater 34. A drawer 82 is provided below the incubator base 21. Reference numeral 83 denotes a collision preventing bumper for preventing the infrared heater 34 from colliding with a wall surface of a ward or the like; reference numeral 84 denotes an operation pedal for adjusting the height or the like of the incubator 81; and reference numeral 86 denotes an operation dial for adjusting the tilt of a bed base 22 shown in FIG. 14.

Figure 13:
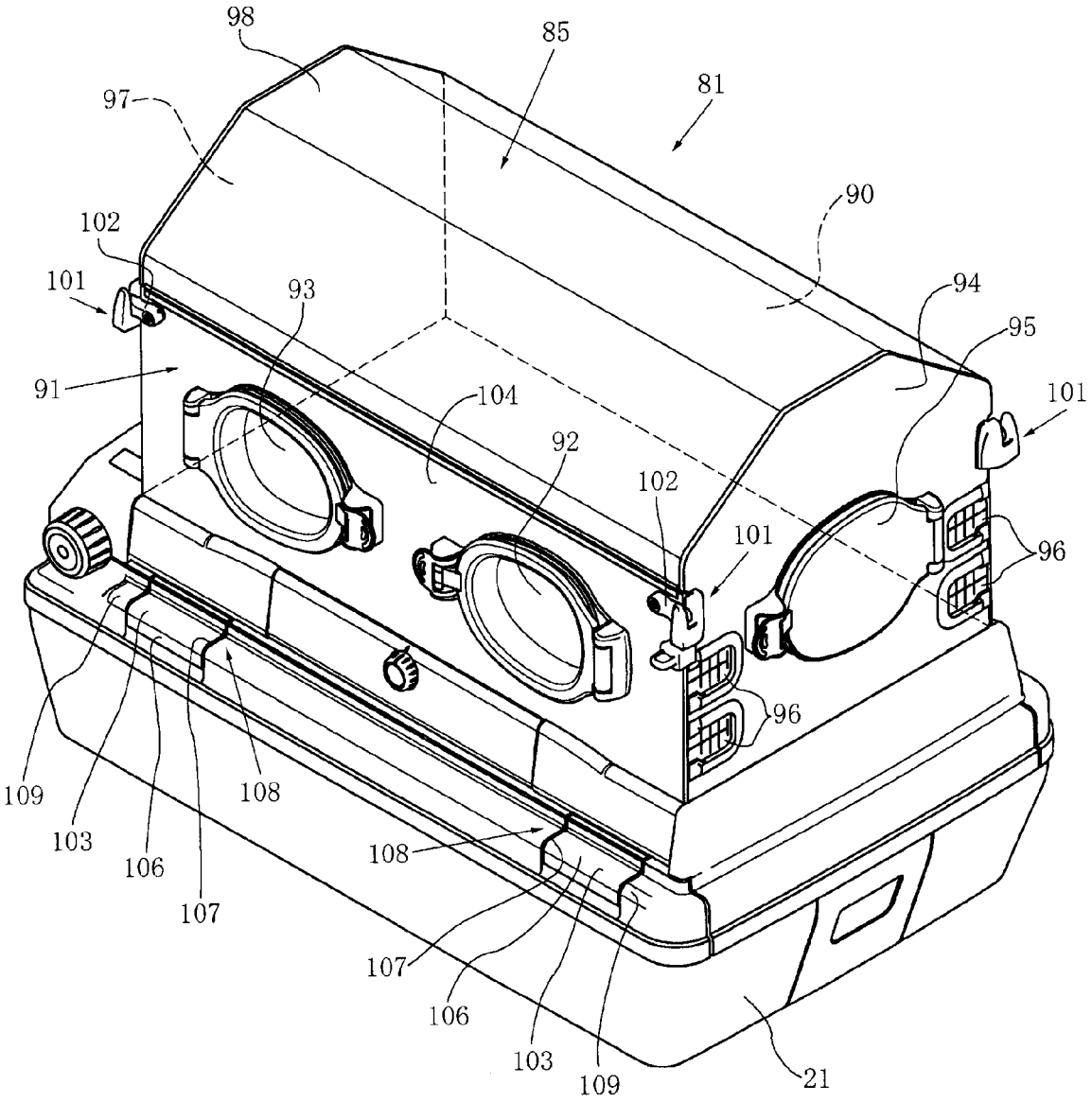
FIG. 13 is a perspective view of the incubator main body shown in FIG. 12.

As shown in FIGS. 12 and 13, the closed type incubator 81 includes a substantially transparent hood 85 covering the upper portion of the incubator base 21. The front surface (in other words, the surface on the right side of an infant) of the hood 85 is provided with a front door 91 as a front wall portion which opens and closes a treatment window used to provide a treatment for the infant and to insert and remove the infant. The front door 91 is provided with a pair of left and right hand insertion windows 92 and 93 in a substantially circular shape or the like. The rear surface of the hood 85 (in other words, the surface on the left side of the infant) is provided with a rear door (in other words, a rear wall portion) 90 which can be similar to the front door 91. A wall portion 94 of the hood 85 which is located on the leg side of the infant is formed as a fixed wall portion. The fixed wall portion 94 is provided with a hand insertion window 95 and a plurality of grommet members 96. A wall portion 97 of the hood 85 which is located on the head side of the infant is also formed as a fixed wall portion. The head-side wall portion 97 can have substantially the same arrangement as that of the leg-side wall portion 94 except that it does not have the hand insertion window 95.

As shown in FIGS. 12 and 13, the front door 91, the leg-side fixed wall portion 94, the rear door 90 and the head-side fixed wall portion 97 form an infant accommodation space 27 which is open upward. The hood 85 includes a canopy portion 98 for covering the upper surface opening of the infant accommodation space 27, and hence allows to have the infant accommodation space 27 as a closed space. The front and rear doors 91 and 90 each can pivot forward, about a portion of a region including the lower end portion and its vicinity in a substantially upward erect position (in other words, in the closed state) shown in FIGS. 12 to 14, to the substantially downward hanging position (in other words, to the open state). These arrangements will be described in detail in the next item "(2) Arrangement of Movable Wall Portion Attachment Mechanism". The hood 85 is provided with pairs of left and right lock mechanisms 101, each pair of which hold a corresponding one of the front and rear doors 91 and 90 in a closed state. Note that reference numeral 102 denotes the operation lever of each lock mechanism 101.

(2) Arrangement of Movable Wall Portion Attachment Mechanism

Figure 14:
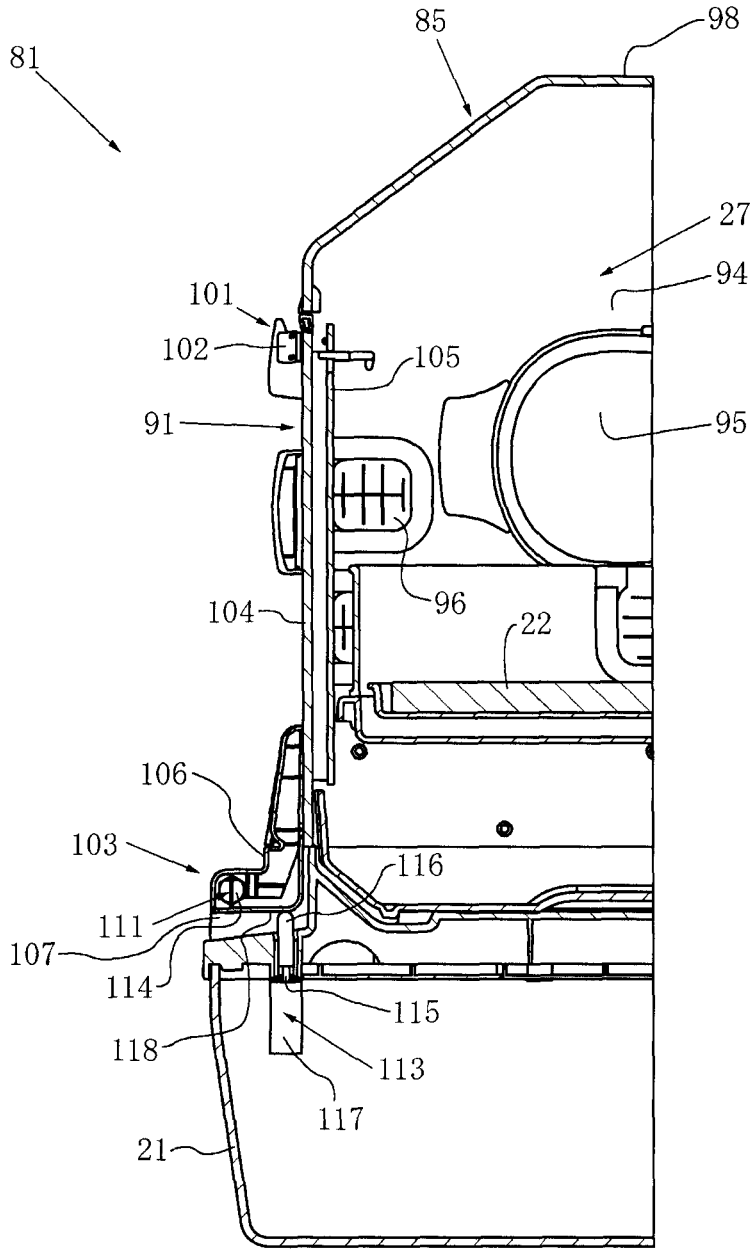
FIG. 14 is a partial sectional view of the incubator main body shown in FIG. 13 taken along a line A-A in FIG. 12.

As shown in FIGS. 12 and 13, the front door 91 is attached to the incubator base 21 with a pair of left and right movable wall portion attachment mechanisms 103 having substantially the same structure except that they are symmetrically formed in the lateral direction. The rear door 90 indicated by the broken line in FIG. 13 is attached to the base 21 with a pair of left and right movable wall portion attachment mechanisms which can have substantially the same structure as that of the movable wall portion attachment mechanisms 103 for the front door 91. Therefore, the movable wall portion attachment mechanisms 103 for the front door 91 will be described in detail below, whereas a description of the movable wall portion attachment mechanisms for the rear door 90 will be properly omitted. As shown in FIG. 14, the front door 91 includes an outside wall portion 104 which can be formed from a substantially transparent plastic plate, an inside wall portion 105 which is formed from a substantially transparent plastic plate having a smaller area than the outside wall portion 104 and is attached to the inside surface of the outside wall portion 104, and attached portions (in other words, movable door proximal portions) 106 in a substantially L shape, each of which is attached to an outside lower portion of the outside wall portion 104 and constitutes a hinge together with an attachment portion 108 in a substantially L shape and a coupling pin 112.

As shown in FIGS. 14 to 17, the movable wall portion attachment mechanisms 103 each include the components described in items (a) to (d) as follows:

(a) the attachment portion 108 in a substantially L shape which is provided on the base 21 so as to have a concave portion 107 in a substantially L shape which can accommodate the attached portion 106 in a substantially L shape;

(b) a rotary damper 111 provided on the attached portion 106 in substantially an L shape;

(c) the coupling pin 112 as a support shaft portion which forms the pivot center of the attached portion 106 in a substantially L shape which is pivotally supported on the attachment portion 108 in a substantially L shape; and (d) a cylinder piston type linear damper 113 which is accommodated in the concave portion 107 in a substantially L shape to abut against the attached portion 106 in a substantially L shape slightly before the front door 91 is set in the closed state so as to suppress the pivoting speed of the front door 91 in the closing direction.

Figure 15:
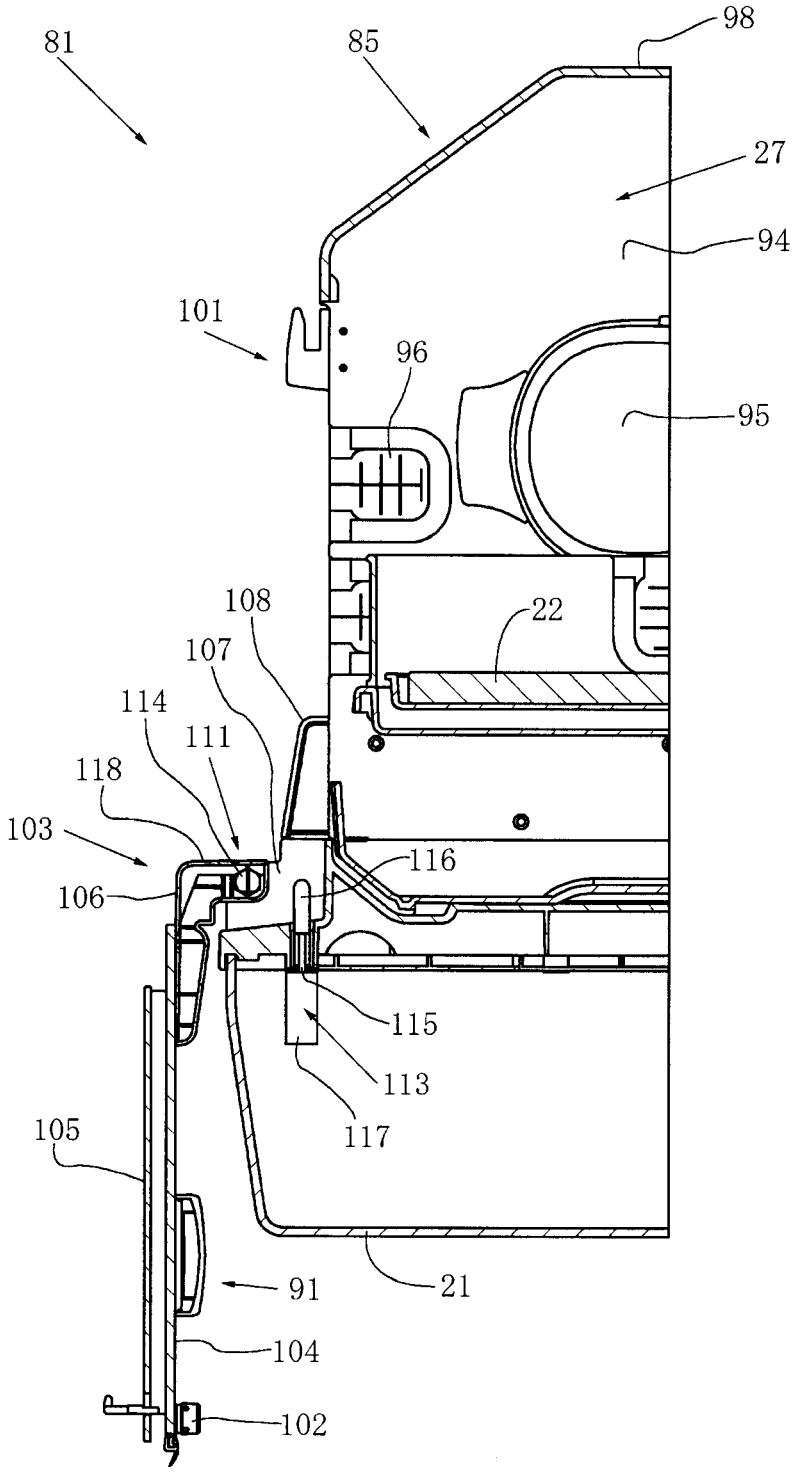
FIG. 15 is a longitudinal sectional view of the incubator main body shown in FIG. 14 while a treatment window opening/closing front door is opened up to a substantially vertically hanging position.

As shown in FIGS. 13 to 15, the attachment portions 108 in a substantially L shape which are provided on the incubator base 21 each include a pair of left and right attachment pieces 109 so as to sandwich the concave portion 107 in a substantially L shape from both the left and right surface sides. As shown in FIGS. 13 and 14, the attached portion 106 in a substantially L shape provided on the front door 91 side is detachably fitted between the pair of left and right attachment pieces 109 (in other words, the concave portion 107 in a substantially L shape). In addition, as shown FIG. 17, the attachment portion 108 is coupled to the attached portion 106 through the coupling pin 112. The front door 91 is therefore attached to the incubator base 21 so as to pivot forward and backward about the coupling pin 112 between the closed state shown in FIG. 14 and the open state shown in FIG. 15. Note that the above three kinds of "substantially L shapes" indicate in particular, in FIGS. 14 to 17, the states viewed from the lower surface sides of the drawings.

Figure 17:
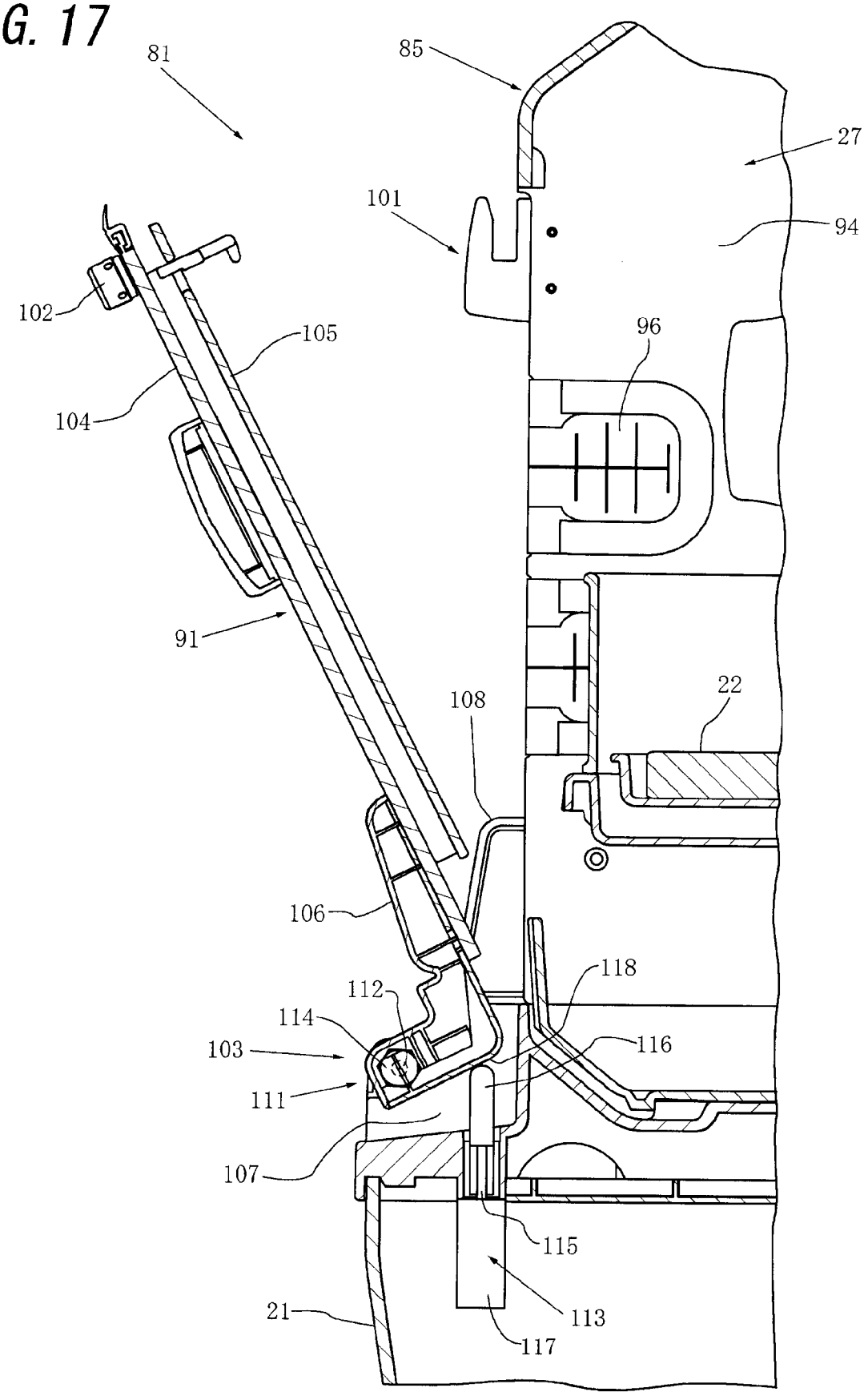
FIG. 17 is an enlarged longitudinal sectional view of the part in FIG. 16.

As shown in FIG. 17, the rotary damper 111 includes a damper main body 114 attached and fixed to the attached portion 106, and a pivot shaft (not shown) attached to the damper main body 114 so as to be relatively pivotal forward and backward. The above pivot shaft is provided substantially coaxially with the coupling pin 112 and is fixed to the attachment portion 108 side in a substantially L shape. Therefore, the damper main body 114 is configured to pivot integrally with the front door 91. When the damper main body 114 pivots forward in the counterclockwise direction in FIG. 17 about its pivot center (in other words, the above pivot shaft) accompanied by the front door 91, the rotary damper 111 applies a large pivoting load (in other words, a force to delay pivoting movement) to the damper main body 114. When the damper main body 114 pivots backward in the clockwise direction in FIG. 17 about its pivot center (in other words, the above pivot shaft) accompanied by the front door 91, the pivoting load applied from the rotary damper 111 greatly decreases to substantially 0.

As shown in FIG. 17, a damper main body 117 of the linear damper 113 is attached and fixed in the incubator base 21. A piston portion 115 of the cylinder piston type linear damper 113 is provided in the concave portion 107 so as to protrude substantially upward. An impact attenuation member 116 formed from an elastic body such as a rubber material is attached to the distal end portion of the piston portion 115. Note that the position of the front door 91 shown in FIG. 17 can be the position where an abutment portion 118 of the attached portion 106 begins to abut against the impact attenuation member 116 or the position where the front door 91 begins to pivot in the closing direction under its own weight when the operator releases his/her hand, which has been holding the front door 91, from the front door 91.

(3) Operation of Movable Wall Portion Attachment Mechanism

In the closed state of the front door 91 shown in FIGS. 12 to 14, the attached portion 106 in a substantially L shape is accommodated in the concave portion 107 in a substantially L shape. The coupling pin 112 serving as the pivot fulcrum of the front door 91 is located below the outside of the outside wall portion 104 of the front door 91 in the closed state of the front door 91 (in other words, below the side on which the front door 91 is opened). In the closed state of the front door 91, the weight of the front door 91 acts in the direction to close the front door 91. If, however, the infant accommodated in the hood 85 kicks the front door 91 from inside, the front door 91 may accidentally open. For this reason, the front door 91 can be held in a locked state by the lock mechanism 101 to hold the front door 91 in a closed state.

In order to open the front door 91 in the closed state shown in FIGS. 12 to 14, first of all, the operator holds the operation lever 102 of the lock mechanism 101 with his/her hand and makes it pivot forward to release the locked state of the front door 91 held by the operation lever 102. The operator then makes the front door 91 pivot forward to the outside about the coupling pin 112 with his/her hand to make the front door 91 pivot forward up to the substantially hanging position shown in FIG. 15. Note that the front door 91 is configured to delay (in other words, suppress) forward pivoting movement to the opening direction by the rotary damper 111. For this reason, even if the operator releases his/her hand from the front door 91 during opening operation for the front door 91, the front door 91 slowly pivots forward to the substantially vertically hanging position.

Figure 16:
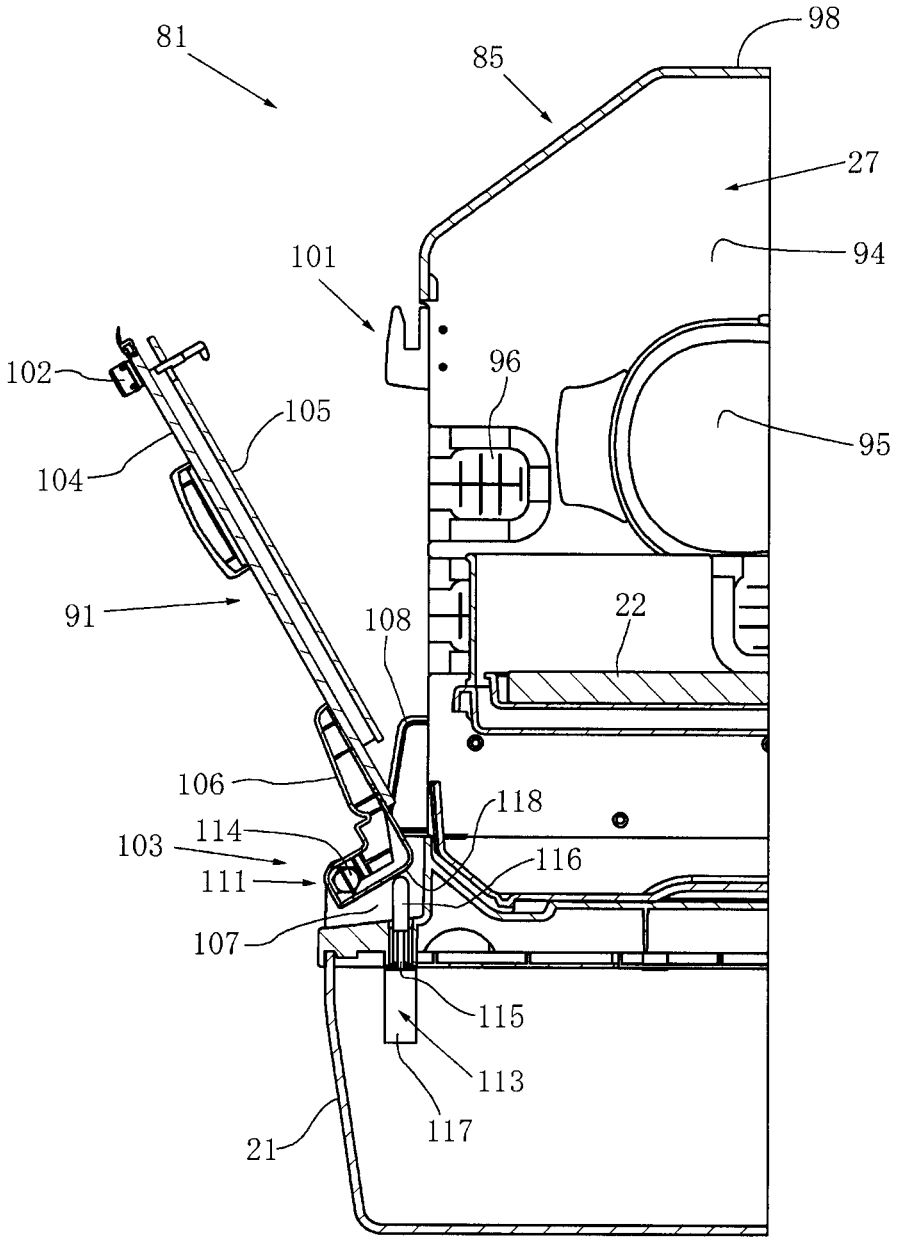
FIG. 16 is a longitudinal sectional view similar to that of FIG. 15 while the treatment window opening/closing front door is closed halfway.

In order to make the front door 91 shown in FIG. 15 pivot backward to the closed state, the operator makes the front door 91 pivot backward in the closing direction with his/her hand. Note that when making the front door 91 pivot backward in the closing direction, since the rotary damper 111 gives the front door 91 no pivoting load against the backward pivoting movement, he/she can make the front door 91 quickly pivot in the closing direction. If, however, the front door 91 quickly pivots backward in the closing state, the front door 91 may impulsively come into contact with the incubator base 21 or the hood 85. This may produce large sound and damage part of the incubator base 21, part of the hood 85 or part of the front door 91. For this reason, as shown in FIGS. 16 and 17, the abutment portion 118 of the attached portion 106 (in a substantially L shape) of the front door 91 touches (in other words, abuts against) the piston portion 115 of the linear damper 113 slightly before the front door 91 is completely closed, the backward pivoting movement of the front door 91 is delayed. Therefore, the incubator 81 shown in FIGS. 12 to 17 is also free from the above drawbacks. Note that the impact attenuation member 116 is attached to the piston portion 115. This further attenuates the impact produced when the attached portion 106 (in a substantially L shape) of the front door 91 comes into contact with the piston portion 115.

As shown in FIGS. 16 and 17, the contact position between the front door 91 and the linear damper 113 may be associated with the barycentric position of the front door 91 and the position of the coupling pin 112 serving as the pivot fulcrum of the front door 91. That is, in the state shown in FIGS. 16 and 17 in which the front door 91 begins to come into contact with the linear damper 113, the barycentric position of the front door 91 can be set to shift from the position immediate above the pivot fulcrum (in other words, the line segment connecting the axis of the pair of left and right coupling pins 112) in the closing direction of the front door 91. In this case, while the front door 91 is in contact with the linear damper 113, even if the operator releases his/her hand from the front door 91, the front door 91 can pivot backward to the closing position under its own weight. With this arrangement, the operator of the front door 91 feels heavy to make the front door 91 pivot backward. This can make the operator intuitively understand that the front door 91 will soon be closed. In addition, even if the operator releases his/her hand immediately before the front door 91 is closed, there is no chance that the front door 91 will pivot forward in the opening direction.

Having described specific preferred embodiments of this invention with reference to the accompanying drawings, it is to be understood that the invention is not limited to that precise embodiments, and that various changes modifications may be effected therein by one skilled in the art without departing from the scope or spirit of the invention as defined in the appended claims.

For example, in the first embodiment, the present invention is applied to the open type incubator. In the second embodiment, the present invention is applied to the closed type incubator. However, the present invention can be applied to a closed type incubator serving also as an open type incubator which is configured to raise and lower a hood like the hood 85 as in the second embodiment.

In the first embodiment, the linear dampers 51 and the rotary dampers 45 are respectively provided for all the movable wall portions 24 to 26. In the second embodiment, the linear dampers 113 and the rotary dampers 111 are respectively provided for all the movable wall portions 90 and 91. In the present invention, however, a liner damper and/or a rotary damper may be provided for at least one of a plurality of movable wall portions.

The invention claimed is:

1. A movable wall portion attachment mechanism of an incubator in which at least one wall portion of a plurality of wall portions attached to an incubator base so as to form an outer circumference of an infant accommodation space is attached as a movable wall portion to said incubator base, wherein said movable wall portion is configured to pivot forward about a portion of a region including a lower end portion of said movable wall portion and a vicinity of said lower end portion of said movable wall portion from a substantially erect position to an outside of said infant accommodation space, wherein when said movable wall portion moves backward from an open state in a backward movement to a midway position, said movable wall portion moves backward to said midway position while abrupt backward movement is not substantially suppressed by damper means, wherein when said movable wall portion moves backward from said midway position in backward movement to a final backward moving position, said movable wall portion moves backward to said final backward moving position by an own weight while abrupt backward movement of said movable wall portion is suppressed by said damper means, wherein said movable wall portion is attached on said incubator base side through a support shaft portion so as to be configured to pivot forward and backward, and an axis of the support shaft portion is configured to move forward and backward in a substantially vertical direction relative to said incubator base, wherein said attachment mechanism further comprises a cam surface provided on said incubator base side, an impact attenuation portion provided on the cam surface and formed from an elastic body by a configuration in which said impact attenuation portion is provided on said incubator base side and constitutes a portion of said cam surface, and a cam surface abutment portion provided on said movable wall portion side, wherein said cam surface abutment portion is configured to abut against said incubator base side first at said impact attenuation portion when said movable wall portion is at a position, where said support shaft portion of said movable wall portion is lowered, and is made to pivot backward from a forward pivot position, wherein when said movable wall portion pivots forward, abrupt forward pivoting movement of said movable wall portion is suppressed by a second damper means, and wherein when said movable wall portion pivots backward, abrupt backward pivoting movement of said movable wall portion is not substantially suppressed by said second damper means.

2. The mechanism of claim 1, comprising one of a movable-side concave engaging means and a moveable-side convex engaging means provided on said movable wall portion side, and one of a fixed-side concave engaging means and a fixed-side convex engaging means provided on said incubator base side, wherein the midway position in the backward movement is a position where said one of a movable-side concave engaging means and a moveable-side convex engaging means is located substantially above said one of a fixed-side concave engaging means and a fixed-side convex engaging means, and wherein the final backward moving position is a position where said one of a movable-side concave engaging means and a moveable-side convex engaging means moves backward from the midway position in the backward movement to a substantially lower position and engages with the one of a fixed-side concave engaging means and a fixed-side convex engaging means.

3. The mechanism of claim 2, wherein said one of a movable-side concave engaging means and a moveable-side convex engaging means comprises an engaging pin, and wherein said one of a fixed-side concave engaging means and a fixed-side convex engaging means comprises an engaging concave portion.

4. The mechanism of claim 1, wherein said cam surface abutment portion comprises an engaging pin, the mechanism further comprises an engaging concave portion provided on said incubator base side, and wherein said engaging pin is configured to be engaged with said engaging concave portion at the final backward moving position.

5. The mechanism of claim 1, wherein said damper means comprises a cylinder piston type linear damper.

6. The mechanism of claim 5, wherein an impact attenuation member formed from an elastic body is provided on at least a distal end portion of a piston portion of said linear damper, and an abutment portion of said movable wall portion side abuts against said impact attenuation member when said movable wall portion moves backward from the midway position in the backward movement to the final backward moving position.

7. The mechanism of claim 1, wherein said second damper means comprises a rotary damper.

8. A movable wall portion attachment mechanism of an incubator in which at least one wall portion of a plurality of wall portions attached to an incubator base so as to form an outer circumference of an infant accommodation space is attached as a movable wall portion to said incubator base, wherein said movable wall portion is configured to pivot forward about a portion of a region including a lower end portion of said movable wall portion and a vicinity of said lower end portion of said movable wall portion from a substantially erect position to an outside of said infant accommodation space, wherein when said movable wall portion moves backward from an open state in a backward movement to a midway position, said movable wall portion moves backward to said midway position while abrupt backward movement is not substantially suppressed by damper means, wherein when said movable wall portion moves backward from said midway position in backward movement to a final backward moving position, said movable wall portion moves backward to said final backward moving position by an own weight while abrupt backward movement of said movable wall portion is suppressed by said damper means, wherein the final backward moving position is a final backward pivot position, wherein said movable wall portion is in a substantially vertical erect position, and the midway position in the backward movement is a position slightly before a position, wherein said movable wall portion pivots backward to the final backward pivot position, wherein when said movable wall portion pivots forward, abrupt forward pivoting movement of said movable wall portion is suppressed by a second damper means, and wherein when said movable wall portion pivots backward, abrupt backward pivoting movement of said movable wall portion is not substantially suppressed by said second damper means.

9. The mechanism of claim 8, wherein said movable wall portion is attached to said incubator base side through a support shaft portion so as to pivot forward and backward, and an axis of said support shaft portion is at a substantially constant position relative to said incubator base.

10. The mechanism of claim 8, wherein said damper means comprises a cylinder piston type linear damper.

11. The mechanism of claim 10, wherein an impact attenuation member formed from an elastic body is provided on at least a distal end portion of a piston portion of said linear damper, and an abutment portion of said movable wall portion side abuts against said impact attenuation member when said movable wall portion moves backward from the midway position in the backward movement to the final backward moving position.

12. The mechanism of claim 8, wherein said second damper means comprises a rotary damper.

* * * * *